US005456384A

United States Patent [19]

Polvere et al.

[11] Patent Number: 5,456,384

[45] Date of Patent: Oct. 10, 1995

[54] DROP CEILING SUSPENDED UNIVERSAL DISPLAY AND DISPENSER

[75] Inventors: Dennis Polvere, Freehold, N.J.; William V. Silver, New York, N.Y.

[73] Assignee: Resources Inc. In Display, Cranford, N.J.

[21] Appl. No.: 260,418

[22] Filed: Jun. 14, 1994

Related U.S. Application Data

[62] Division of Ser. No. 178,804, Jan. 7, 1994.

[51] Int. Cl.[6] ..... B65G 59/00

[52] U.S. Cl. ..... 221/283; 312/50; 248/343

[58] Field of Search ..... 221/282, 283; 248/343, 317; 52/39; 312/50, 9.55, 9.53, 9.47

[56] References Cited

U.S. PATENT DOCUMENTS

| | | | |
|---|---|---|---|
| 657,779 | 9/1900 | Kirchhoffer | 312/50 |
| 1,182,233 | 5/1916 | Waddell | 312/9.55 |
| 4,319,421 | 3/1982 | Diamond | 248/343 |
| 4,396,237 | 8/1983 | Henry | 312/50 |

*Primary Examiner*—Kenneth Noland
*Attorney, Agent, or Firm*—Jay H. Maioli

[57] ABSTRACT

A dispenser and display device is suspended by a ceiling element that is inserted in a drop ceiling in place of a standard drop ceiling panel. The ceiling element has a number of channels formed to run in different directions, so that the dispenser can assume various orientations. The dispenser has a main body that has gravity feed, article-holding trays movably mounted inside so that the trays can be released without removal from the main body. The trays can be rearranged relative to the main body so that dispensing of articles can take place from the front, rear, or both sides of the main body.

10 Claims, 8 Drawing Sheets

DROP CEILING SUSPENDED UNIVERSAL DISPLAY AND DISPENSER

This is a division of application Ser. No. 08/178,804, filed Jan. 7, 1994 now pending.

BACKGROUND OF THE INVENTION

1. Field of the Invention

This invention relates generally to devices for use in dispensing articles and, more particularly, to dispensing devices that are at a raised position relative to the user of the device.

2. Description of the Background

Relatively small packaged articles are frequently dispensed in retail establishments at or near the cash register or check out counter. There are known devices that contain a large number of such packages, such as cigarette packs, that have the packages arrayed so that either the check-out clerk or the consumer can make the selection of the desired brand or particular individual article. In order to save counter space, typically such dispensers are elevated or raised relative to the counter top so that the clerk reaches up and grasps the desired article. Such raised dispensers can be bolted or otherwise fastened to the wall of the establishment adjacent the cash register or the dispenser may be provided with legs, so that the dispenser is positioned above the general eyesight line of the clerk. In addition, there have been proposed dispensers and the like that are to be bolted to the ceiling and suspended above the head of the clerk, so that the clerk then reaches up and then grasps the appropriate selection as indicated by the consumer.

In all such previously proposed devices, the installation of the dispenser is generally permanent. That is, fasteners such as bolts or lag screws or nails or the like are employed to secure the dispenser at the desired raised elevation, substantially above the height of the counter top.

One disadvantage that has been encountered with this kind of raised or elevated dispensing device is that it becomes difficult to restock the device without using a ladder or step stool or the like. Thus, the usefulness of the elevated dispenser becomes limited. Another drawback is that typically this kind of dispenser is intended for use from only one side. That is, either the clerk can select the desired brand or the consumer can make his own selection but the same dispenser does not provide both options.

Another drawback with the known dispensers of this kind is that because the installations are somewhat permanent, a large amount of effort is required in order to both install the dispensers and to move the dispenser to a different location. For that reason, such dispensers are almost never mounted at any location other than the location of the check-out counter or cash register, because such check-out counters are typically quite permanent.

OBJECT AND SUMMARY OF THE INVENTION

Accordingly, it is an object of the present invention to provide a dispenser for packaged articles of the kind having a generally raised location that can eliminate the above-noted defects inherent in the prior art.

Another object of this invention is to provide a dispensing device that is raised relative to the users's location that can be easily mounted in an existing suspended or drop ceiling.

A further object of the present invention is to provide a dispenser device for packaged articles that can be suspended from a drop ceiling and that can be easily reloaded or restocked without disassembling the dispenser or lowering it from its installed position.

A still further object of this invention is to provide a dispenser device for packaged articles that is suspended from a drop ceiling that has provision for providing displays or advertising on the outer surfaces of the device.

It is also an object of this invention to provide a dispenser device for packaged articles that can be suspended from a drop ceiling and from which both the store personnel and the consumer can make individual selections of desired articles.

In accordance with an aspect of the present invention, a ceiling element is sized to fit an opening in a standard drop ceiling channel network and has a universal pattern formed thereon, whereby an article dispensing device can be fitted thereto in an easy fashion and can assume a large number of various orientations. The dispenser device itself has display panels on the front or back or both to provide graphics including advertisements or price information. The dispenser device has movable article containers or trays that can be repositioned for easily restocking the articles and then easily positioned back into a locked, raised condition to resume normal operation. The above and other features and advantages of the present invention will become apparent from the following detailed description of illustrative embodiments thereof to be read in conjunction with the accompanying drawings, in which like reference numerals represent the same or similar elements.

DESCRIPTION OF THE PREFERRED EMBODIMENT

Figure 1:
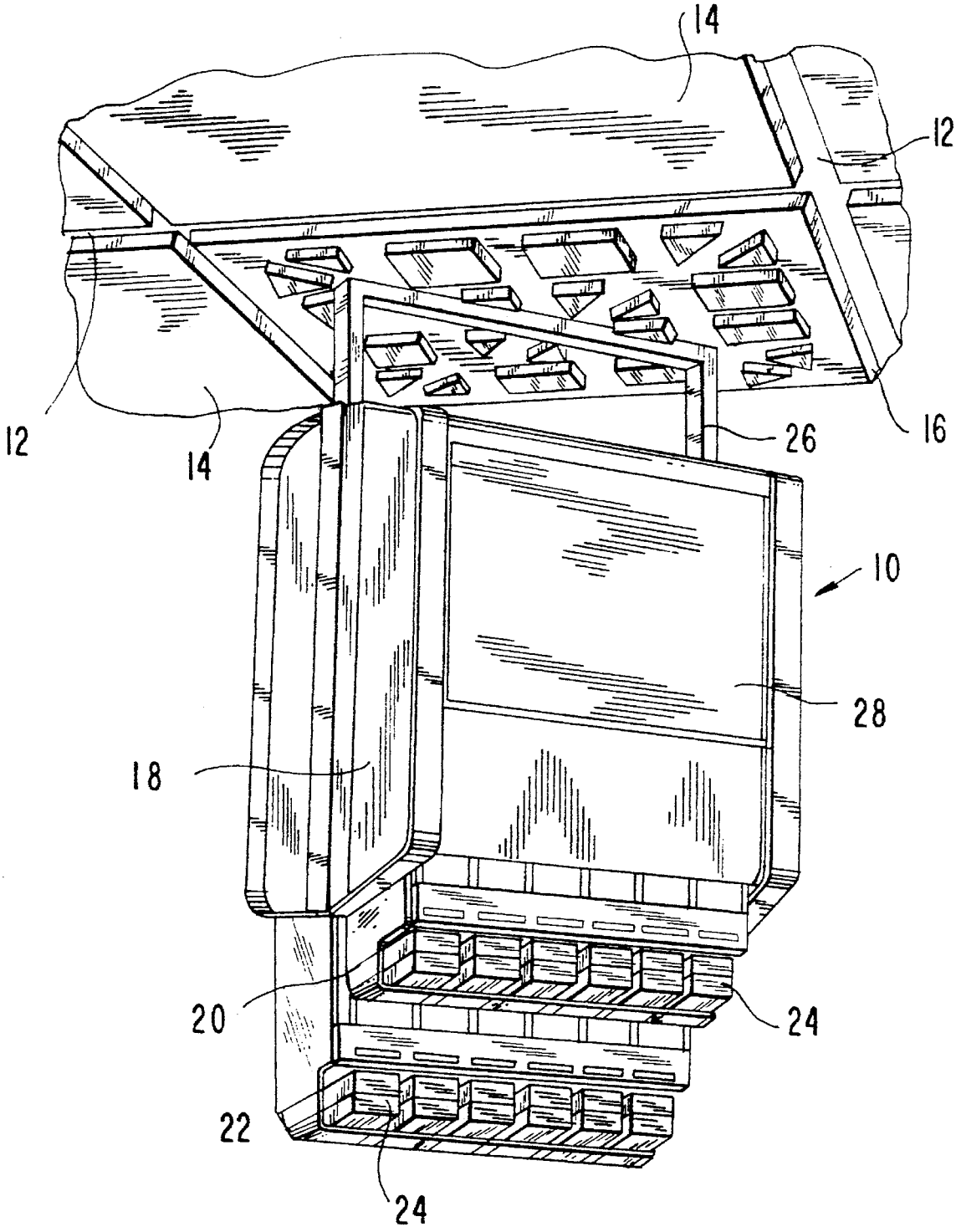
FIG. 1 is a pictorial representation of a dispenser and display device installed in an existing drop ceiling according to an embodiment of the present invention.

In FIG. 1, an embodiment of the inventive display and dispenser device is shown generally at 10. The device is shown installed in an existing drop ceiling and such drop ceiling is known to consist of a network of channels 12 that are arranged in a grid-like pattern and that are suspended from the ceiling of a room by wires or threaded rods or the like. As is well known, ceiling tiles, shown generally at 14, are then provided to be dropped into the grid work formed by the channels 12. The openings of the grid formed by the channels 12 are usually either two foot squares or are two foot by four foot rectangles. According to the present invention, one of such ceiling tiles is removed and a special universal-mount, ceiling element 16 is inserted in place of the standard tile. The structure of the ceiling element 16 is shown in more detail in FIG. 3 and will be described hereinbelow.

The display and dispensing device has a main body 18 that houses two gravity feed trays 20 and 22 whose operation will be described in more detail below. Each of the gravity feed trays contains a number of packaged articles, such as cigarettes, panty hose, candy, or the like. Such articles are shown typically at 24 in FIG. 1. The main body 18 of the display and dispenser device is affixed to the ceiling element 16 by a framework 26. Each of the front and back panels of the main body 18 can support a display panel, one of which is shown at 28 in FIG. 1.

Figure 2:
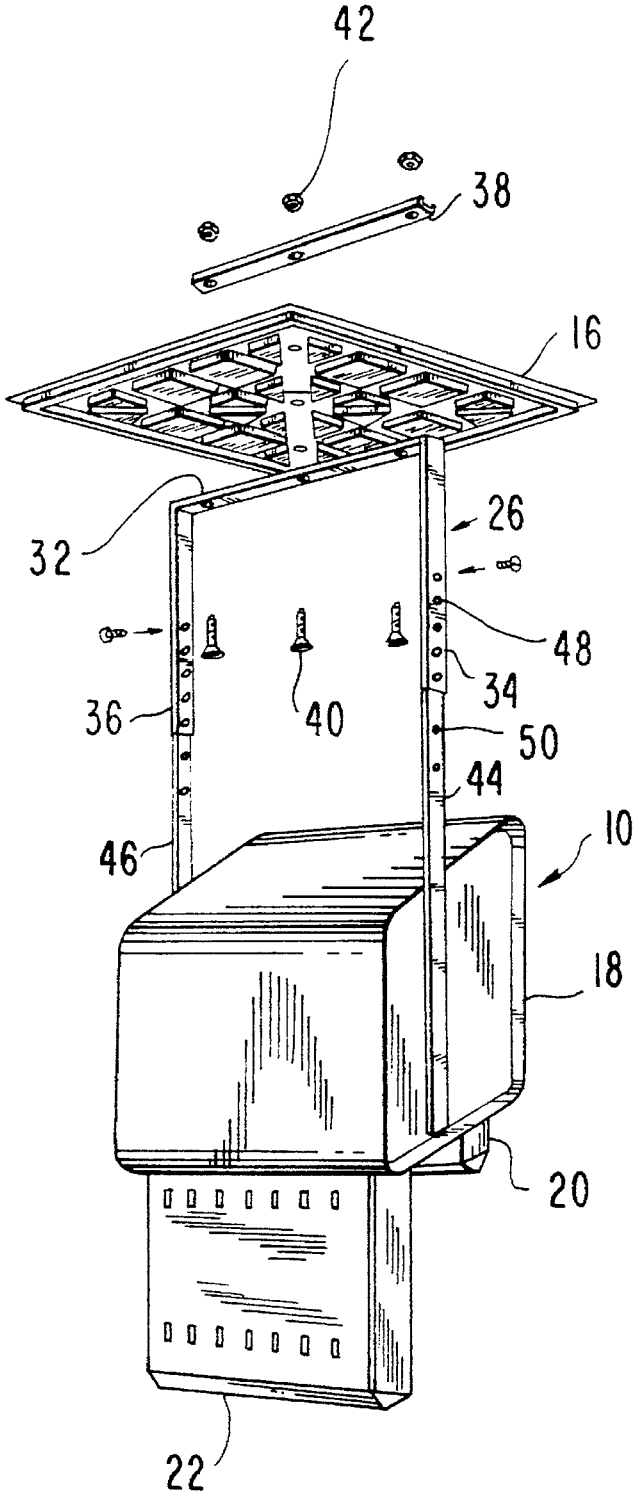
FIG. 2 is an exploded view of the dispenser and display device according to the embodiment of the present invention shown in FIG. 1.

FIG. 2 shows the embodiment of the present invention of FIG. 1 in an exploded view in which the manner in which the framework 26 is attached to the ceiling element 16 is shown in detail. Specifically, the framework 26 consists of a U-shaped, downwardly depending frame that has a horizontal top bar 32 attached to left and right depending leg elements 34 and 36. The framework 26 is fastened to the ceiling element 16 by placing the horizontal top bar 32 into any one of the several channels formed in the ceiling element 16. Once desired orientation is obtained then a clamp bar 38 is placed on the other side of the ceiling element 16 and fastened to the top bar 32 by means of suitable fasteners, such as bolt and nut assemblies, shown typically at 40 and 42, respectively. Of course, any corresponding fastener approach can be employed, for example, the clamp bar 38 can be drilled and tapped in place of utilizing nuts 42. The main body 18 has at each side upraised arm elements 44 and 46 that slide into legs 34 and 36, respectively. A plurality of holes 48 may be provided in the legs 34 and 36 and, similarly, holes 50 can be provided in legs 44 and 46. Arms 44 and 46 are telescopingly engaged with legs 34 and 36 so that the actual distance between the main body 18 and the ceiling element 16 can be adjusted to any of a number of different positions. Once the desired position is reached, fasteners such as 52 can be placed once the appropriate holes 48 and 50 are in alignment.

Thus, it is a feature of this embodiment of the present invention that the main body 18 of the dispenser and display unit can be easily adjusted to adapt to any ceiling height from eight feet to twelve feet, for example. In the embodiment of FIG. 2, the front and rear dispensing units 20 and 22 are also shown, with the rear dispensing unit 22 being in its lowermost position suitable for use in reloading articles contained therein. Such operation will be explained in more detail hereinbelow.

Figure 3:
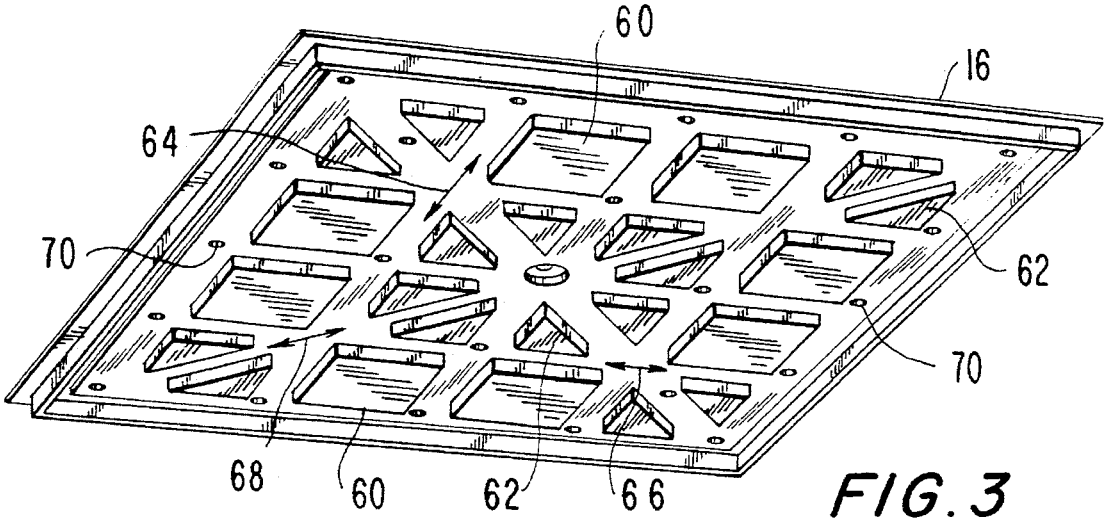
FIG. 3 is a perspective view of the ceiling element of the devices of FIG. 1 according to an embodiment of the present invention.

FIG. 3 shows the ceiling element 16 in greater detail in which it is seen that a number of channels are provided within which the top bar 32 of the frame 26 may reside. Specifically, these channels are formed by a number of raised units formed in the ceiling element 16. These raised units or lands can take the form of either a rectangle or a triangle. A plurality of rectangular units 60 are provided along with a plurality of triangular units 62. By appropriately arranging the rectangular units 60 and the triangular units 62, both left-to-right and front-to-back channels can be provided, as well as diagonal channels extending from the respective corners of the ceiling element 16. More specifically, a front-to-back channel is shown generally by arrow 64 and a left-to-right channel is shown typically by arrow 66. Similarly, one of the two diagonal channels is shown by arrow 68. A plurality of through-holes, shown typically at 70, are provided in ceiling element 16 so that upon a proper placement of the top bar 32 and the corresponding arrangement of the clamp bar 38, the fasteners 40 may be passed through the top arm 32 and holes 70 and clamp bar 38 for securing by the fastening nuts 42.

Accordingly, a ceiling tile element 16 such as shown in FIG. 3 provides a universal mounting structure, so that by positioning the top bar 32 in any of the several channels formed by the lands 60 and 62, any orientation that is desired can be provided for the main body 18 of the display and dispenser device. Ceiling element 16 is shown in FIG. 3 as a generally square, planar element that is intended to fit into a two foot by two foot space formed by the gridwork of the channels of the drop ceiling. On the other hand, in the event that the drop ceiling has a two foot by four foot gridwork, then the ceiling element 16 occupies simply one-half of the area typically occupied by a ceiling tile and such existing tile may be cut in half to occupy the remainder of the space unoccupied by ceiling element 16.

Figure 4A:
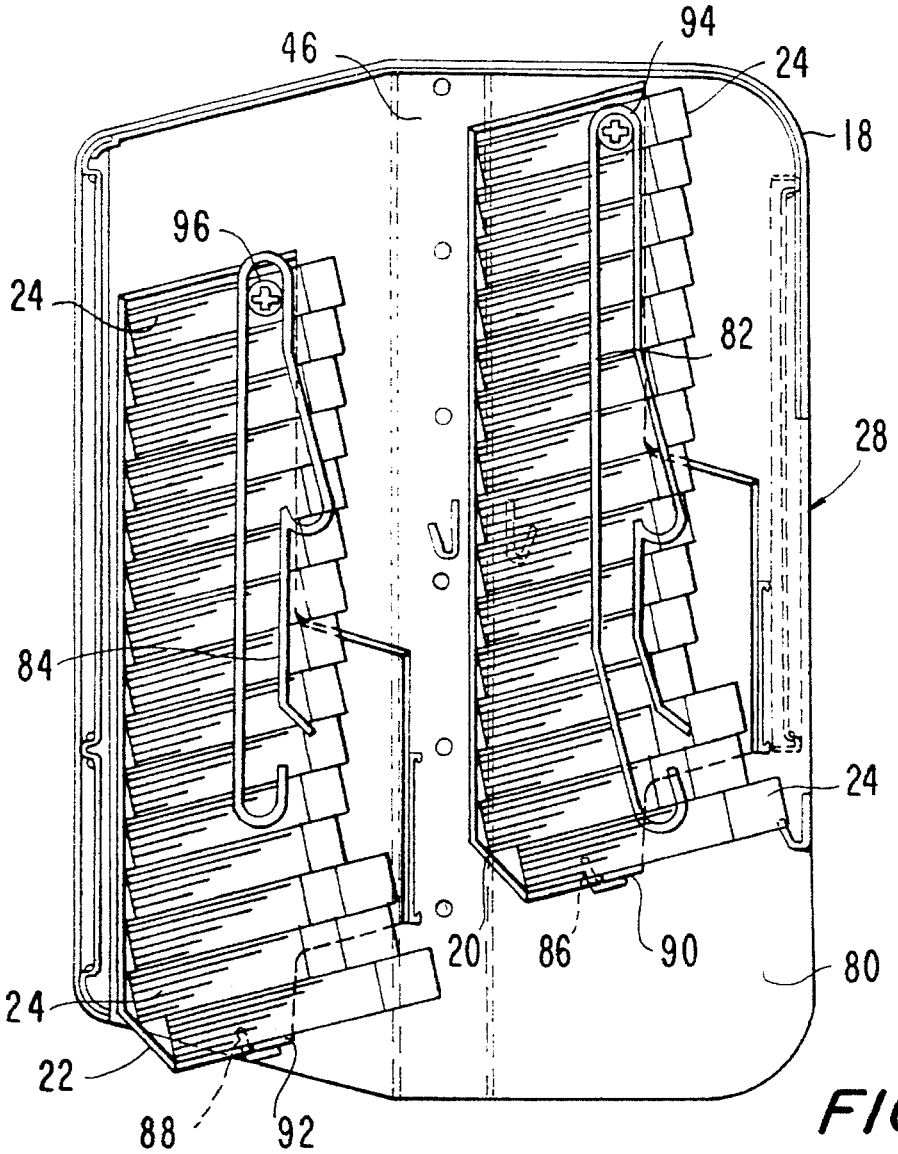
FIGS. 4A and 4B are cutaway views of a dispenser device for use by a store personnel making a desired selection according to an embodiment of the present invention.

FIG. 4A shows the manner in which the gravity feed trays or article racks 20 and 22 are retained within the housing 18. FIGS. 4A through 6B are elevational views of the housing 18 from the left side, with the left outer wall of the housing being shown as if it were transparent so that the mounting arrangement for the gravity feed trays can be seen.

Thus, in FIG. 4A gravity feed tray 20 is shown containing the articles 24 and the rear gravity feed tray 22 is shown also containing the articles 24. In the position shown in FIG. 4A, the inventive dispenser is arranged for a clerk or sales personnel to make the selection as requested by the customer. Thus, the trays are in the same general position as was shown in FIG. 1, for example. At the lower right-hand corner of the body 18 shown in elevation in FIG. 4A is a generally open space 80 so that the clerk can reach in and make the appropriate selection.

Each tray 20 and 22 rides in its own pair of channels that are formed on the inside surfaces of the side walls of the housing 18. Since FIG. 4A is a side elevational with the outer wall being removed or being determined as being transparent, the left side channel for tray 20 is shown at 82, and the left-side channel for the rear tray 22 is shown at 84. As noted above, the trays 20 and 22 are in the dispensing position after having been fully loaded, as represented by the stacks of articles 24 and the trays 20 and 22 are retained in the body 18 by L-shaped stops or rests 86 and 88, respectively. Tray 20 has a tab at 90 at the lower corner that interacts with the stop 86 and, similarly, tray 22 has tab 92 that interacts with stop 88. The right side tabs and stops are not seen in FIG. 4A. Each tray 20 and 22 also has at the top thereof a pair of guide pins, the leftmost one for tray 20 is shown at 94 and, similarly, the leftmost guide pin for tray 22 is shown at 96. These pins 94 and 96 ride in the respective channels 82 and 84 and limit the motion of the respective trays 20 and 22.

Figure 4B:
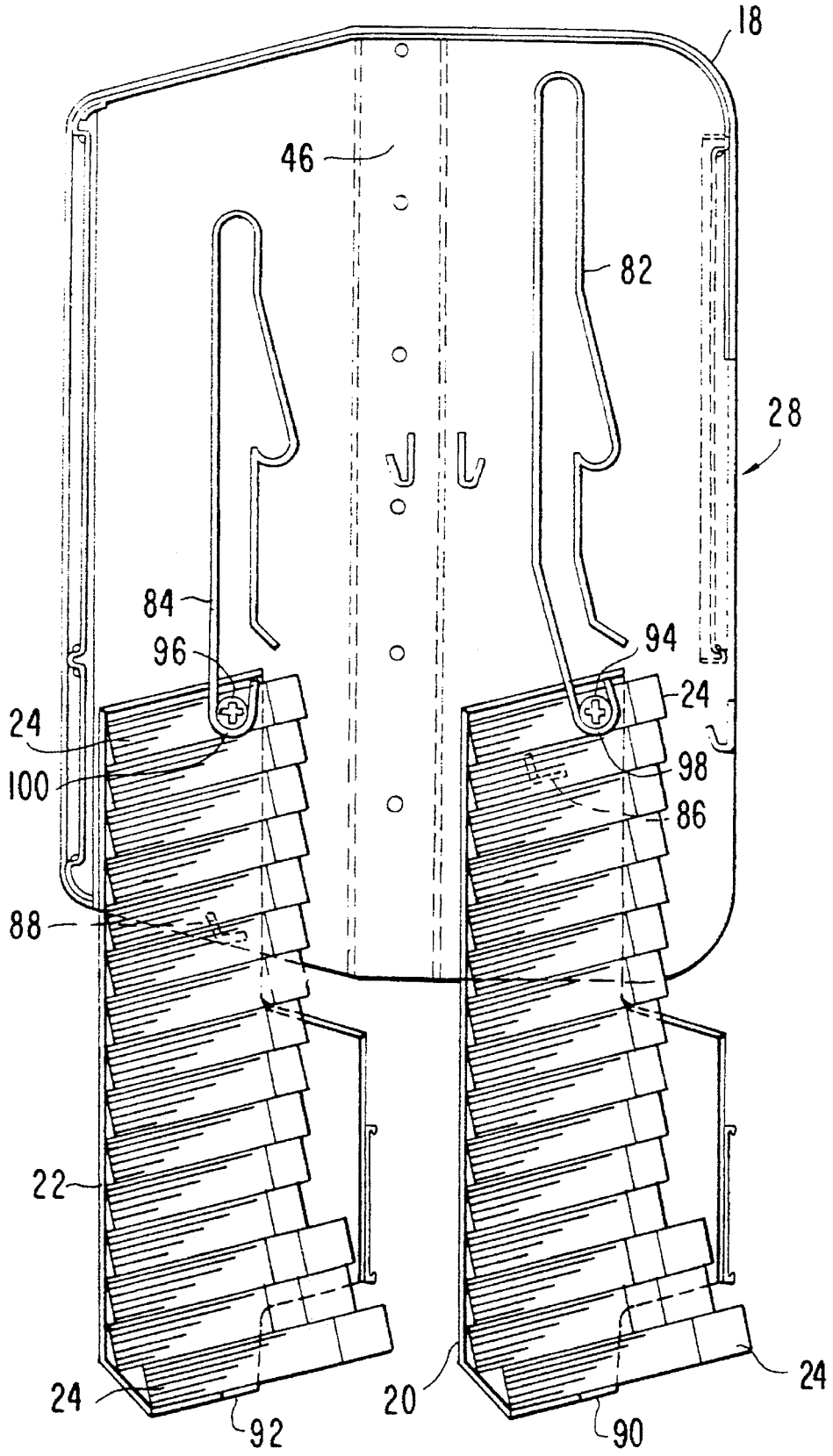

In that regard, FIG. 4B shows the trays 20 and 22 in the lowermost position so that they can be reloaded or restocked and, in fact, they have already been restocked as shown in FIG. 4B because each tray 20 and 22 is completely full of the articles 24 to be dispensed.

In the tray positions shown in FIG. 4B, the guide pins 94 and 96 are resting in lowermost U-shaped segments 98 and 100, respectively, of the two respective guide channels 82 and 84. Thus, to obtain the positions of trays 20 and 22 as shown in FIG. 4B starting from the positions of FIG. 4A, the trays are simply rocked forward so that the tabs 90 and 92 are released from the stops 86 and 88, respectively, and then the trays are lowered until the guide pins 94 and 96 come to rest in the U-shaped portions 98 and 100, respectively, which thereby act to support the respective trays 20 and 22.

Figure 5A:
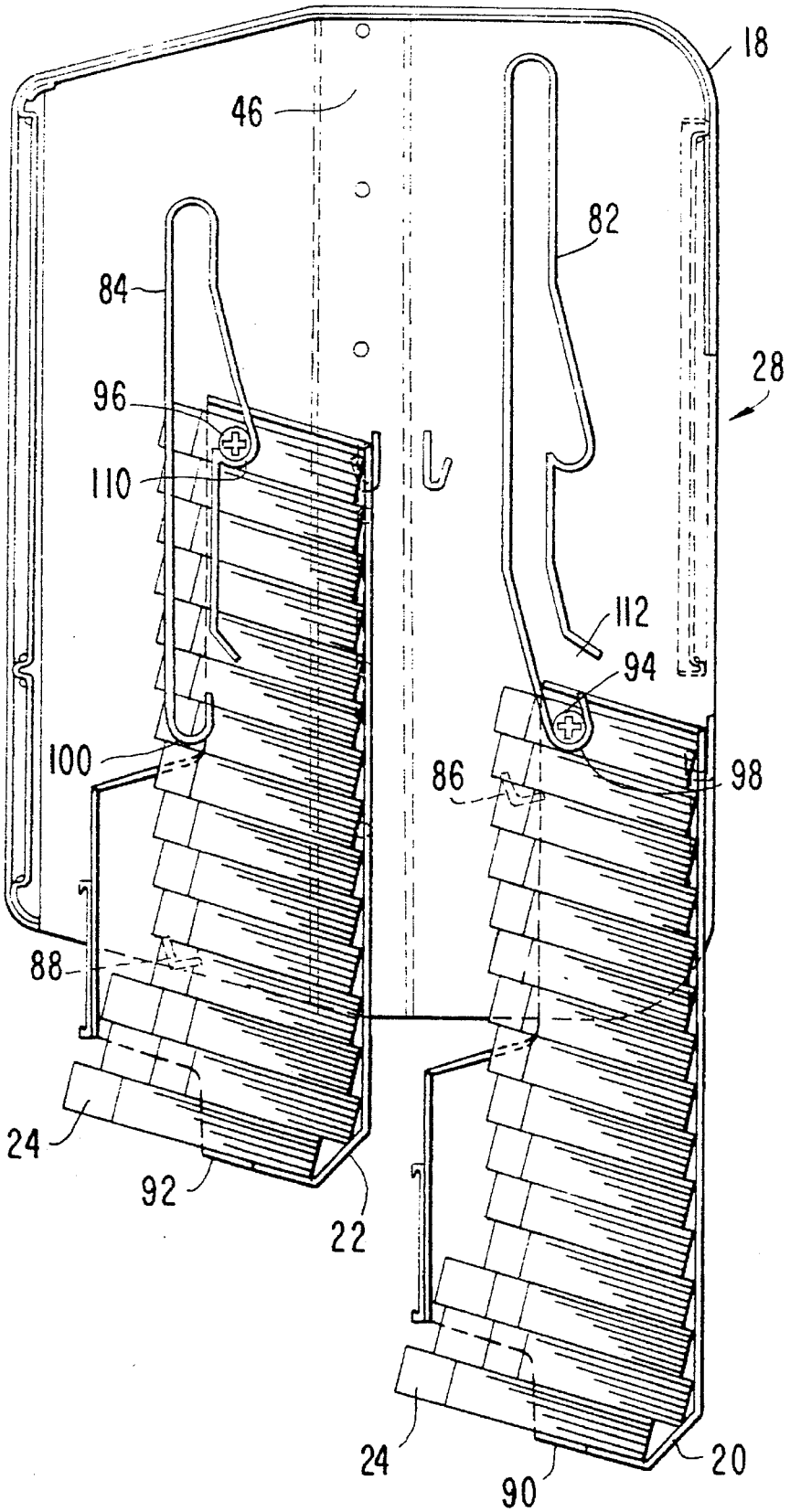
FIGS. 5A and 5B are cutaway views of a dispenser device for use by a consumer making a desired selection according to an embodiment of the present invention.
Figure 5B:
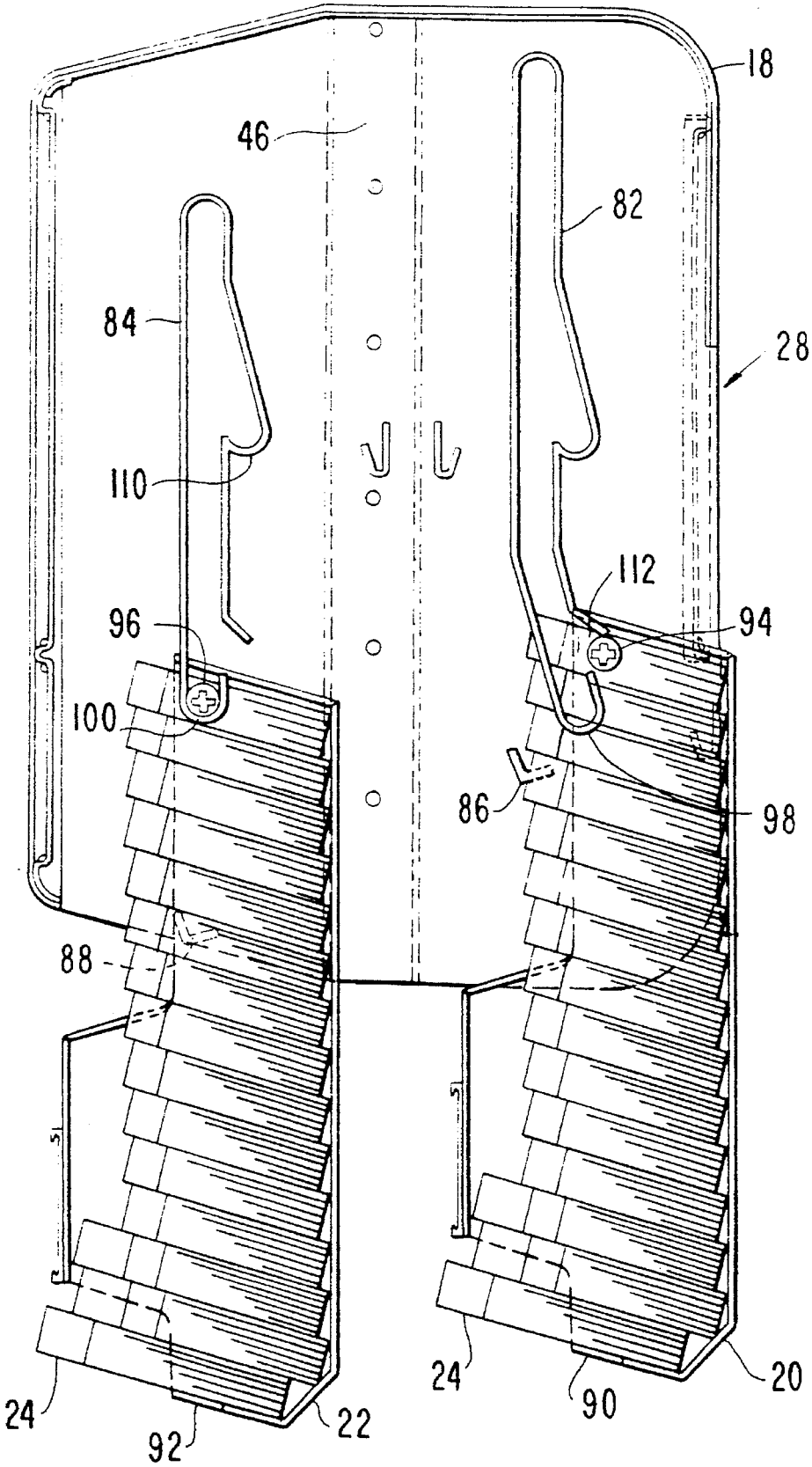

FIG. 5A shows an embodiment of the present invention in which the gravity feed dispensing trays 20 and 22 are reversed relative to the body 18 so that instead of the check-out clerk or cashier, for example, making the selection of the desired articles, the consumer makes his own selection from the opposite side of the housing. Because the present invention provides a universal arrangement, all of the parts shown in FIGS. 5A and 5B are exactly the same as those of FIGS. 4A and 4B and the only difference is the manner in which the trays and their respective guide pins interact with the guide channels formed on the inside surfaces of the side walls of the housing 18. Specifically, the orientation of the trays 20 and 22 is reversed from that as shown in FIGS. 4A and 4B, so that now the left or rear tray 22 becomes the front tray and faces toward the left in FIG. 5A, and the front tray 20 faces the left as well as and now becomes the rear tray. In this arrangement the rear tray 20 is arranged to be suspended by its guide pins 94 at the lowermost U-shaped element of channel 82, in what was previously described as the loading position. Nevertheless, in this arrangement that position is the operating position, and the tray 20 remains suspended from the U-shaped channel 98 by means of its guide pins 94. On the other hand, tray 22 is in an intermediate position by reason of its guide pin 96 residing within a support portion 110 formed approximately halfway along guide channel 84.

FIG. 5B shows a reloading arrangement of the trays 20 and 22, wherein the previous rear tray, but now the front tray in this reversed orientation 22, is at its lowermost position with the guide pins 96 residing in the lower U-shaped portions 100 of guide channel 84. On the other hand, the other gravity feed tray 20 is typically operated in its lowermost position so that in order to reload or restock the tray 20, it is easier to simply remove it from the housing 18. An opening 112 is provided in channel 82 so that the guide pins 98 can be lead through the openings 112 and the tray 20 removed for restocking. FIG. 5B shows the guide pin 94 in the opening 112, however, the opening 112 is seen more clearly in FIG. 5A without the guide pin 94 residing therein.

Figure 6A:
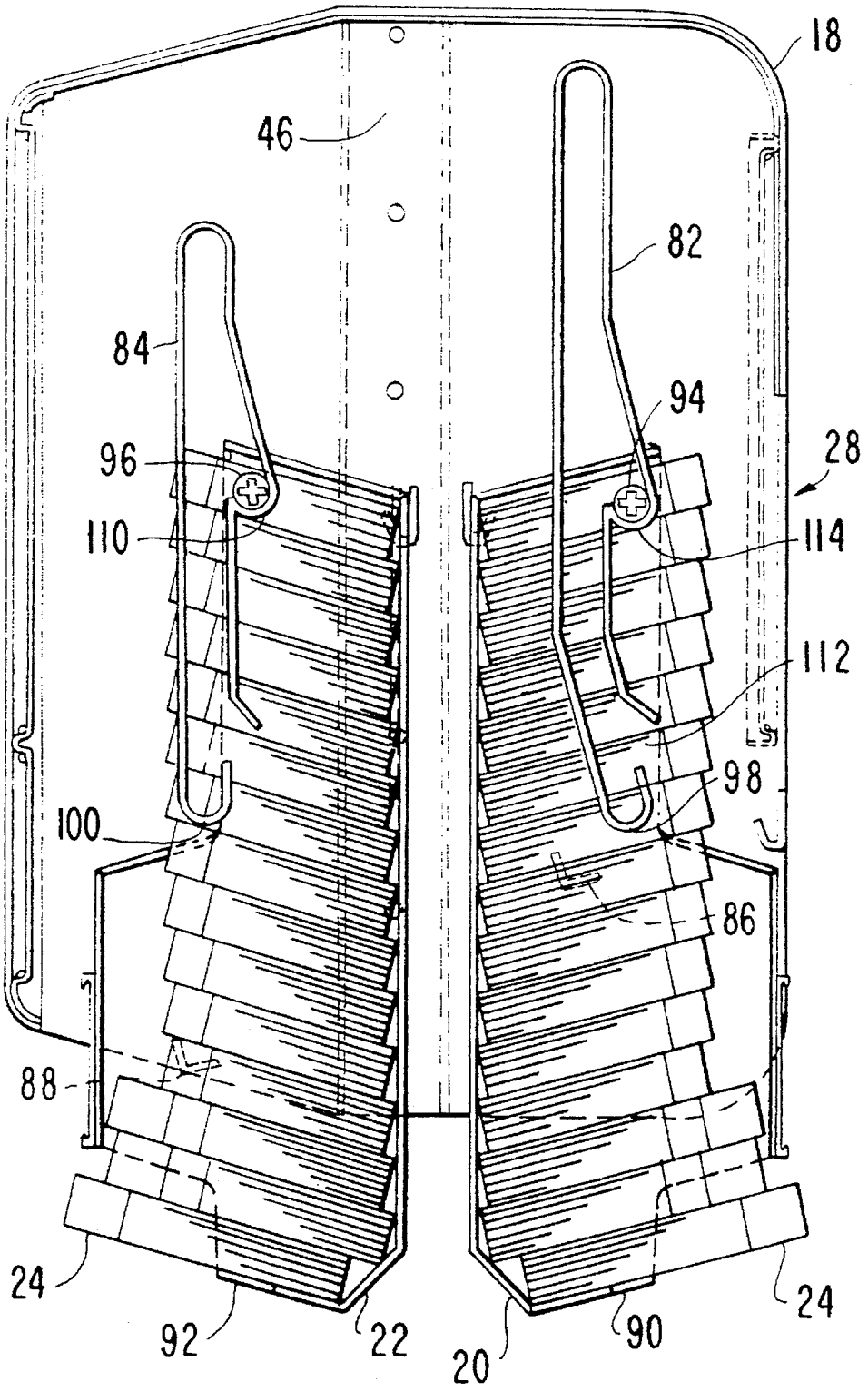
FIGS. 6A and 6B are cutaway views of a dispensing device wherein both a consumer and a clerk can make a desired selection according to an embodiment of the present invention.
Figure 6B:
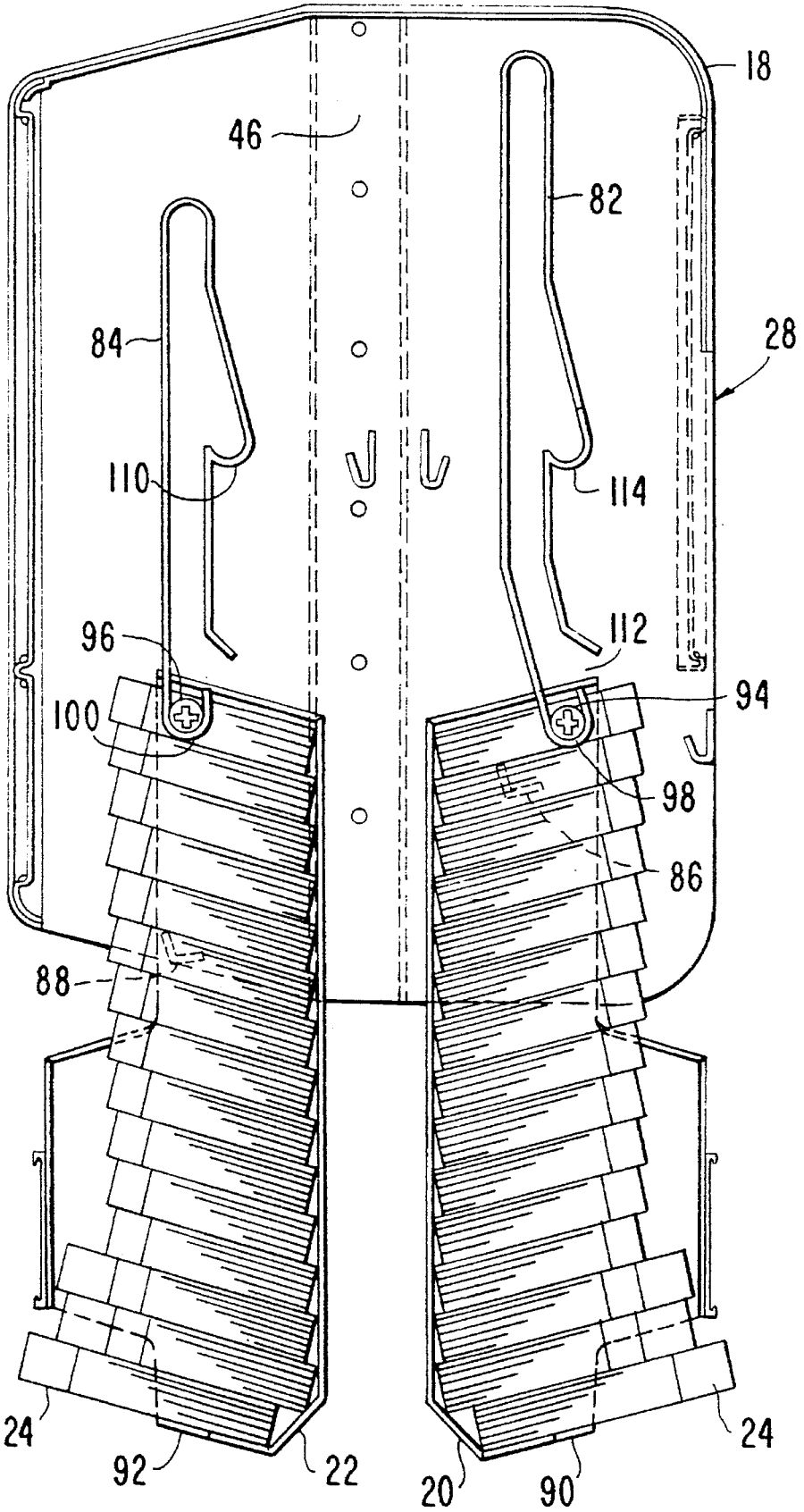

FIGS. 6A and 6B show the gravity feed trays 20 and 22 arranged within the housing 18 in such a fashion that both the consumer or customer and the clerk or cashier can make selections from the dispenser. Thus, gravity feed tray 20 faces to the right, which is typically suggested as being toward the cashier, and gravity feed tray 22 faces to the left, which has been described as being toward the customer.

FIG. 6A shows the trays 20 and 22 relative to the housing in their operating positions, in which relative to tray 20 guide pins 94 reside in the support portions 114 and thereby suspend tray 20 at an intermediate position within housing 18. On the other hand, tray 22 is in the same position as shown in FIG. 5A wherein guide pins 96 reside in support portions 110 and thereby suspend tray 22 at the intermediate position within the housing 18.

FIG. 6B shows a reloading position of trays 20 and 22, wherein relative to tray 20 pins 94 reside within the lowermost U-shaped channels 98 and permit access to the tray 20 for reloading, and relative to tray 22 pins 96 reside in the lowermost U-shaped channels 100, thereby suspending tray 22 for the reloading operation.

Although the present invention has been described hereinabove with reference to the preferred embodiment, it is to be understood that the invention is not limited to such illustrative embodiment alone, and various modifications may be contrived without departing from the spirit or essential characteristics thereof, which are to be determined solely from the appended claims.

What is claimed is:

1. A device for use in connection with a ceiling of a room for displaying articles for sale, said device comprising:

an article dispenser affixed to and downwardly depending from said ceiling; and a plurality of trays movably mounted in said article dispenser for holding articles to be dispensed wherein each of said plurality of trays is movable in a downward direction for loading said articles thereon.

wherein said article dispenser includes a main body and means for adjustably mounting said trays within said main body for movement between at least an article loading position and an article dispensing position, wherein each of said plurality of trays includes an opening through which said articles are dispensed, and wherein said main body has a front portion and a back portion and said means for adjustably mounting mounts said plurality of trays in said main body with the openings facing said front portion.

2. The device according to claim 1, wherein said article dispenser has a cube-shaped main body and further comprising a display panel formed on at least one flat surface of said cube-shaped body.

3. A device for use in connection with a ceiling of a room for displaying articles for sale, said device comprising:

an article dispenser affixed to and downwardly depending from said ceiling; and a plurality of trays movably mounted in said article dispenser for holding articles to be dispensed, wherein each of said plurality of trays is movable in a downward direction for loading said articles thereon.

wherein said plurality of trays comprises a first tray and a second tray; and wherein said main body has a front portion and a back portion and said means for adjustably mounting mounts said first tray with the opening facing said front portion and said second tray with the opening facing said back portion.

4. The device according to claim 3, wherein said article dispenser includes a main body and means for adjustably mounting said trays within said main body for movement between at least an article loading position and an article dispensing position, wherein each of said plurality of trays includes an opening through which said articles are dispensed.

5. The device according to claim 3, wherein said article dispenser has a cube-shaped main body and further comprising a display panel formed on at least one flat surface of said cube-shaped body.

6. A device for use in connection with a ceiling of a room for displaying articles for sale, said device comprising:

an article dispenser affixed to and downwardly depending from said ceiling; and a plurality of trays movably mounted in said article dispenser for holding articles to be dispensed wherein each of said plurality of trays is movable in a downward direction for loading said articles thereon, wherein said article dispenser includes a main body and means for adjustably mounting said trays within said main body for movement between at least an article loading position and an article dispensing position, wherein each of said plurality of trays includes an opening through which said articles are dispensed, and wherein said main body has a front portion and a back portion and said means for adjustably mounting mounts said plurality of trays with the openings facing said back portion.

7. The device according to claim 6, wherein said article dispenser has a cube-shaped main body and further comprising a display panel formed on at least one flat surface of said cube-shaped body.

8. A device for use in connection with a ceiling of a room for displaying articles for sale, said device comprising:

an article dispenser affixed to and downwardly depending from said ceiling; and a plurality of trays movably mounted in said article dispenser for holding articles to be dispensed wherein each of said plurality of trays is movable in a downward direction for loading said articles thereon, wherein said article dispenser includes a main body and means for adjustably mounting said trays within said main body for movement between at least an article loading position and an article dispensing position, wherein each of said plurality of trays includes an opening through which said articles are dispensed, and wherein said means for adjustably mounting includes a plurality of guide channels and U-shaped support portions arranged on inner surfaces of side walls of said main body, and further comprising guide pins formed at upper ends of said trays and cooperating with said guide channels to guide each of said plurality of trays between an upper position, and an intermediate position and a lower position.

9. The device according to claim 8, further comprising a pair of L-shaped stops for each of said plurality of trays, one of said pair of L-shaped stops being formed on an inner surface of a left side wall of said main body and another of said pair of L-shaped stops being formed on an inner surface of a right side wall of said main body in an opposing relationship, and a pair of tabs for each of said plurality of trays, one of said pair of tabs being formed at a lower left side of each of said plurality of trays and another of said pair of tabs being formed at a lower right side of each of said plurality of trays, said pair of tabs interacting with said pair of L-shaped stops for retaining each of said plurality of trays in said main body.

10. The device according to claim 8, wherein said article dispenser has a cube-shaped main body and further comprising a display panel formed on at least one flat surface of said cube-shaped body.

* * * * *